US005887405A

United States Patent [19]

Carranza-Aubry

[11] Patent Number: 5,887,405

[45] Date of Patent: Mar. 30, 1999

[54] PRECAST INTEGRAL STRUCTURE ELEMENTS AND PROCEDURE FOR THE FAST CONSTRUCTION OF BUILDINGS WITH SUCH ELEMENTS

[76] Inventor: Rene Carranza-Aubry, Av. Nuevo León 249, Planta Baja, 06100 Hipódromo Condesa, Mexico

[21] Appl. No.: 859,776

[22] Filed: May 21, 1997

Related U.S. Application Data

[63] Continuation of Ser. No. 531,609, Sep. 21, 1995, abandoned.

[30] Foreign Application Priority Data

Sep. 22, 1994 [MX] Mexico ..... 947274

[51] Int. Cl.[6] ..... E04B 1/00

[52] U.S. Cl. ..... 52/745.1; 52/236.3; 52/236.6; 52/250; 52/745.05

[58] Field of Search ..... 52/250, 251, 259, 52/234, 236.3, 236.6, 745.05, 745.1

[56] References Cited

U.S. PATENT DOCUMENTS

| | | | |
|---|---|---|---|
| 1,924,801 | 8/1933 | Olmstead . | |
| 2,339,220 | 1/1944 | Crowley | 52/236.6 X |
| 2,864,251 | 12/1958 | Imbrogno et al. | 52/236.6 |
| 3,304,675 | 2/1967 | Graham-Wood et al. | 52/236.6 |
| 3,710,527 | 1/1973 | Farebrother | 52/259 X |
| 4,035,971 | 7/1977 | Hay | 52/236.6 |
| 4,147,009 | 4/1979 | Watry | 52/259 X |
| 4,302,915 | 12/1981 | Stocks | 52/251 X |
| 4,669,240 | 6/1987 | Amormino | 52/259 X |
| 4,974,380 | 12/1990 | Bernander et al. | 52/236.6 X |
| 5,233,808 | 8/1993 | Salmenmaki et al. | 52/234 X |

FOREIGN PATENT DOCUMENTS

| | | | |
|---|---|---|---|
| 72772 | 7/1951 | Denmark | 52/251 |
| 650634 | 2/1951 | United Kingdom | 52/259 |

*Primary Examiner*—Christopher Kent
*Assistant Examiner*—Timothy B. Kang
*Attorney, Agent, or Firm*—Nikaido, Marmelstein, Murray & Oram LLP

[57] ABSTRACT

The present invention refers to the improvements made to precast integral structure elements used in the fast construction of several-floor buildings made with hollow core slabs that have the same length wanted for the buildings height, thus allowing the construction of a prototype building in very short mounting and assembly times. Such structure elements are extruded slabs made of prestressed concrete which act as one piece bearing walls of the buildings height, as floor structure and ceiling slabs, and as parapet slab.

6 Claims, 6 Drawing Sheets

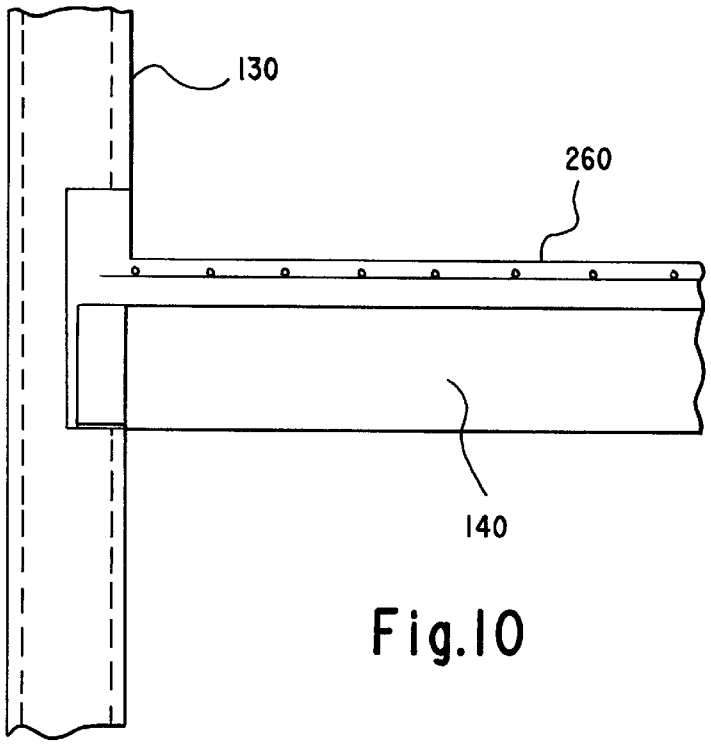
Fig.10
Fig.11
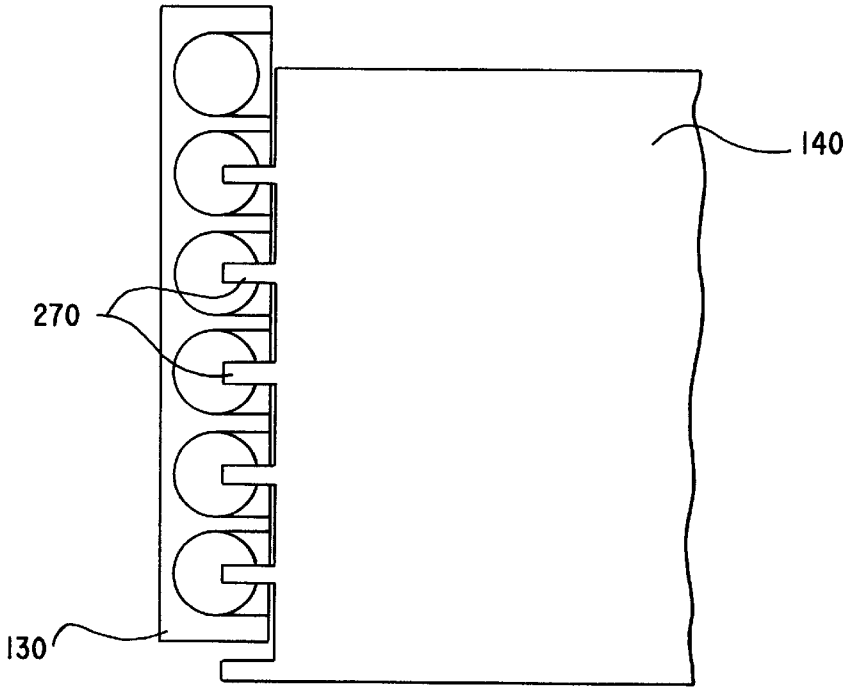

PRECAST INTEGRAL STRUCTURE ELEMENTS AND PROCEDURE FOR THE FAST CONSTRUCTION OF BUILDINGS WITH SUCH ELEMENTS

This application is a continuation of application Ser. No. 08/531,609 filed Sep. 21, 1995, now abandoned.

BACKGROUND OF THE INVENTION

The present invention is related to the construction industry, and particularly with a procedure for the construction of several floor buildings with a swiftness not known until now, where the building's walls and units making up that wall have a length equal to its total height. This means that the building will be free of horizontal junctions in the floor structures. This invention consists also of new structural elements; particularly hollow core slabs made of prestressed concrete, that can be used with versatility in the aforementioned procedure.

The present invention resides in the improvements made to precast integral structure elements used in the fast construction of several-floor buildings made with hollow core slabs that have the same length wanted for the building's height. This allows the construction of a prototype building in very short erecting and assembly times. Such structure elements are extruded slabs made of prestressed concrete which act as one piece bearing walls of the buildings height and can also act, as floor structure and ceiling slabs, and as parapet slabs.

This invention is based particularly on the employment of these slabs and on the constructed buildings themselves. The present invention also resides in the construction procedures, that consist of the following stages or steps:

1. Building the foundation (either of the pneumatic-caisson or box type, or the cradle type) that may be poured in situ or precast or a mixture of both;
2. Vertically fixing the precast integral wall structure elements;
3. Longitudinally joining the vertical wall structure elements to form the bearing walls;
4. Placing the necessary fixating and support components on the bearing walls for the floor structure and ceiling slabs;
5. Placing integral precast slabs on their edge or inclined and resting them over the support components, thus forming horizontally extending vertical parapet beams;
6. Fixing these slabs to the walls by means of post-tensioning cables that run through the upper and lower cavities of the slabs and cross through the walls to the exterior face of the walls thus anchoring the slabs to the exterior face of the walls thus forming frames;
7. Laying further integral precast slabs horizontally over the support elements, serving as floor structures and ceilings.

Even though the general construction technique that uses prior structural precast elements is now widely known, this technique is also known for not being optimized, because the joining of the structural precast elements has been complex and slow.

These inconveniences make the construction costs high, and even higher yet when erecting a building of several floors, because before this invention there was a wall for each floor, making it absolutely necessary to employ horizontal connections between them.

BRIEF DESCRIPTION OF THE INVENTION

One advantage of the present invention is that in the construction of several-floor buildings, the foundation may be either precast, poured in situ or mixed, depending on the soil type.

Another advantage of this invention is that the walls used are hollow cored and extruded, and can be connected longitudinally with a low cost.

An additional advantage of the present invention is the way the walls are joined. It has been modified to form a junction that can be of either of the following three types:

1. Castles or head frames poured in situ,
2. Female-male type walls, and
3. Walls placed edge to edge, (these edges having semi-circle depressions that when placed in contact with one another form a cylindrical cavity that is filled with cement grout that seals the vertical joint).

This invention has also the relevance of allowing the floor structure slabs to be fixed either by bell and spigot, by concrete brackets or metallic angles.

Yet another advantage of the present invention is that the slabs are also precast extruded and hollow, and the junction between them and the walls is made by pouring in situ over these slabs.

One last advantage of the present invention is the placing of the shear wall built by extension or prepoured in diverse ways.

BRIEF DESCRIPTION OF THE DRAWINGS

These and other objectives and advantages of this invention will be in part obvious or will be apparent as the description proceeds, based on the attached drawings, where the same reference numbers correspond to similar parts.

FIG. 10 is a cross sectional view of a floor structure over an extruded wall, box and spigot (vertical view) in accordance with the present invention FIG. 11 is a cross sectional upper view of the junction of the floor structure over an extruded wall, in accordance with the present invention (box and spigot type).

DETAILED DESCRIPTION OF PREFERRED EMBODIMENTS

Figure 1:
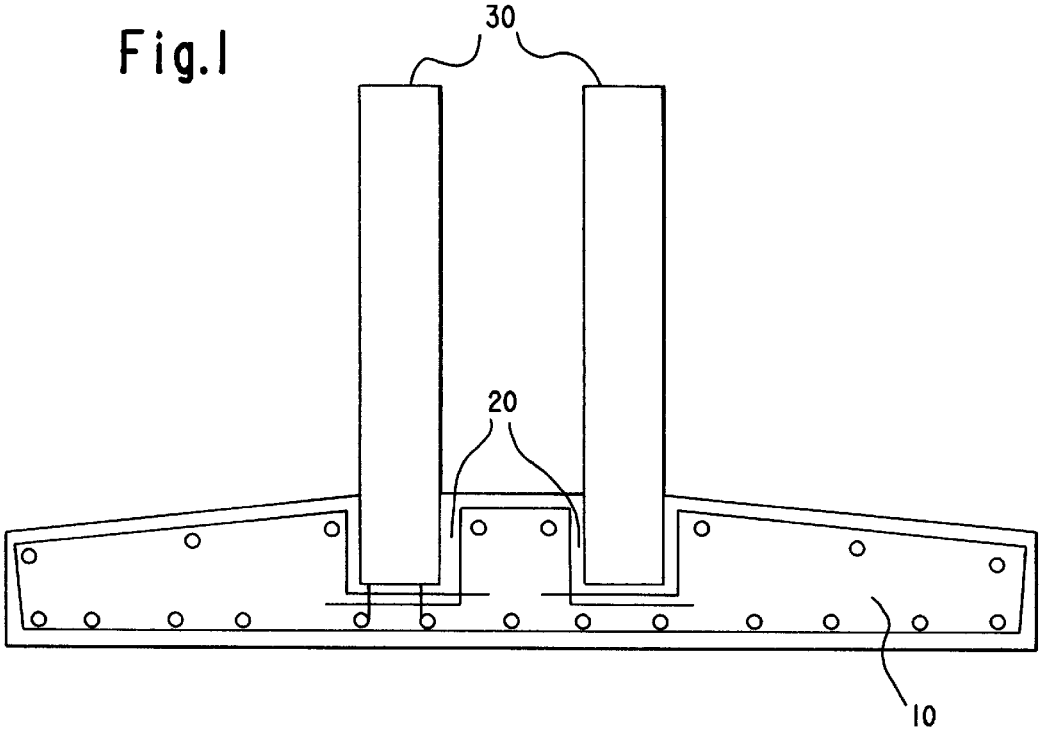
FIG. 1 is a cross sectional view of the mixed foundation, in accordance with the present invention.
Figure 2:
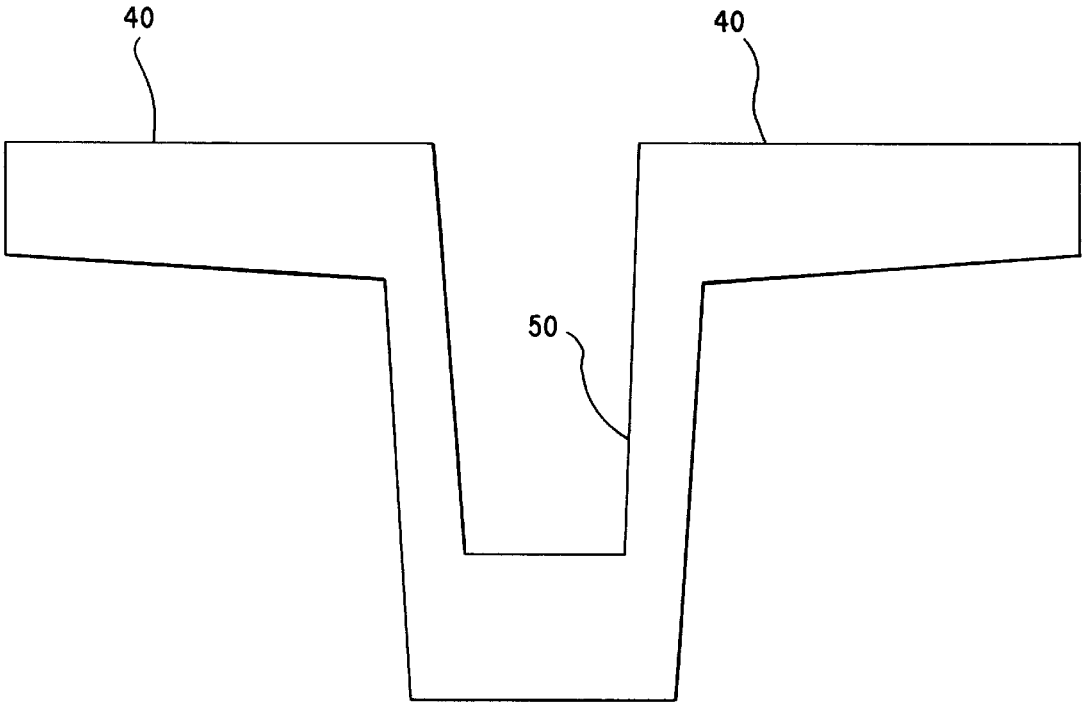
FIG. 2 is a cross sectional view of the box or pneumatic-caisson type foundation, in accordance with the present invention.
Figure 3:
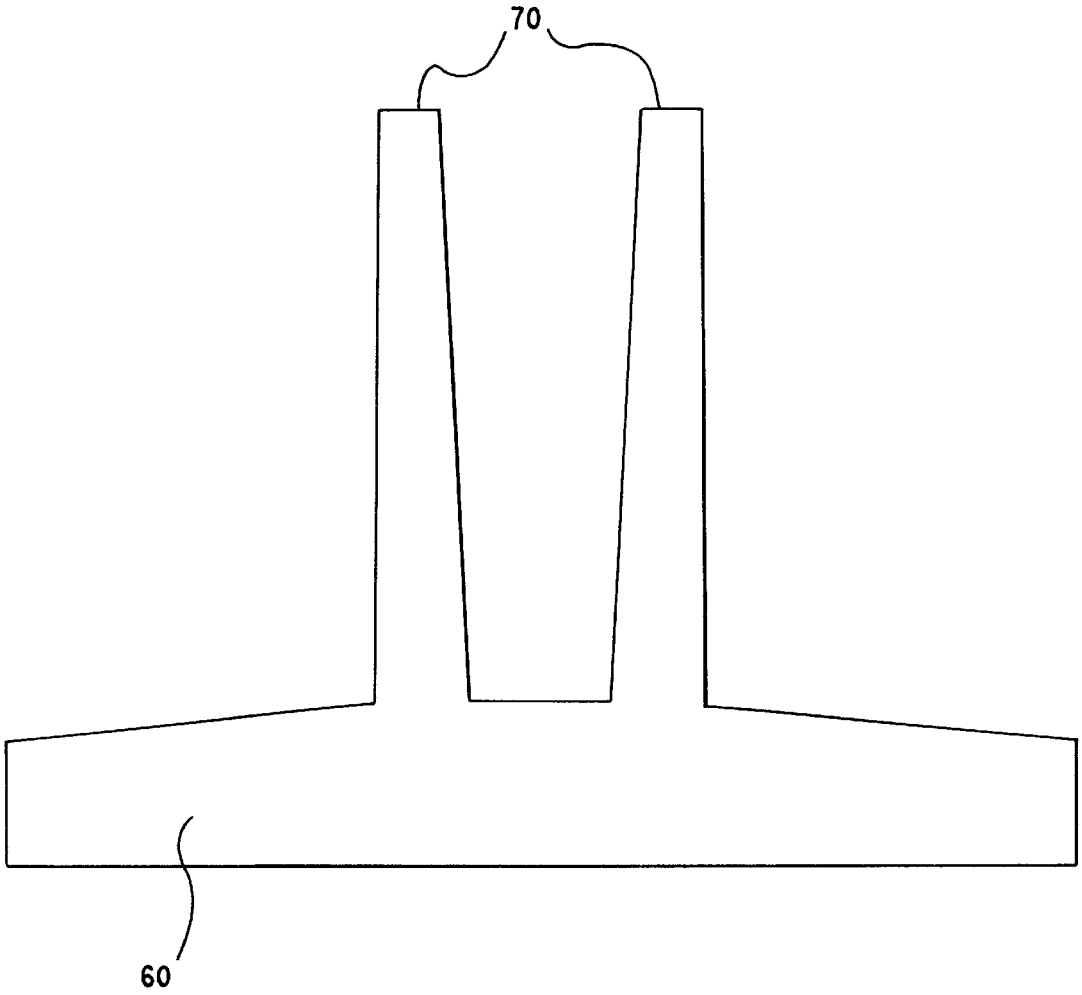
FIG. 3 is a cross sectional view of the cradle type foundation, in accordance with the present invention.

FIGS. 1–3 show various support structure alternatives for constructing a building in accordance with the present invention. In the first of these in FIG. 1, in accordance with one technique of the present invention, a mixer type foundation is prepared, in which a shoe 10 is poured at the construction site. This shoe 10 has two shallow canals 20 which support uprights 30 over which the extruded walls are placed.

FIG. 2 shows another foundation technique that can be considered a box foundation and can be poured in-situ or can be completely precast. This type of box foundation has shoes 40 at the sides of a canal 50 into which the extruded wall is directly introduced.

FIG. 3 shows a precast foundation of the cradle type, having a shoe 60 and two uprights 70 with facing inner sides, closer at the base than at the top, which are to support the extruded wall.

In each of these foundation systems, the manner of attaching the extruded walls is the same: after having placed the extruded wall slab(s) in the canal, the remaining space between the sides of the canal and the slab(s) is filled with volume stabilizing additive to ensure the junction. Most generally, concrete is poured into the space between the slab(s) and the canal.

The choice of which foundation method and which foundation members are used for a given building at a given location depend upon the compressibility information and load bearing capacity of the site. A mechanical earth study of the site is advisable or the opinion of an expert in foundations is needed.

The slabs or wall pieces which are used in the present invention are a constant width of 120 cm and vary in thickness and length depending upon the size of the building being constructed. For buildings up to three stories tall (8.5 m), the preferred thickness of the slab is 15 cm. For buildings up to four stories tall (11.0 m), the preferred thickness of the slab is 20 cm. For buildings up to five stories tall (16.0 m), the preferred thickness of the slab is 25 cm. For buildings up to eight stories tall (21.5 m) , the preferred thickness of the slab is 30 cm.

The slabs or wall pieces are of prestressed concrete with the vertically extending reinforcing members positioned adjacent the outer surfaces and spaced between the internal hollow cores. The concrete which is used is f' c=350 kg/cm$^2$ and 2400 kg/m$^3$.

Figure 4:
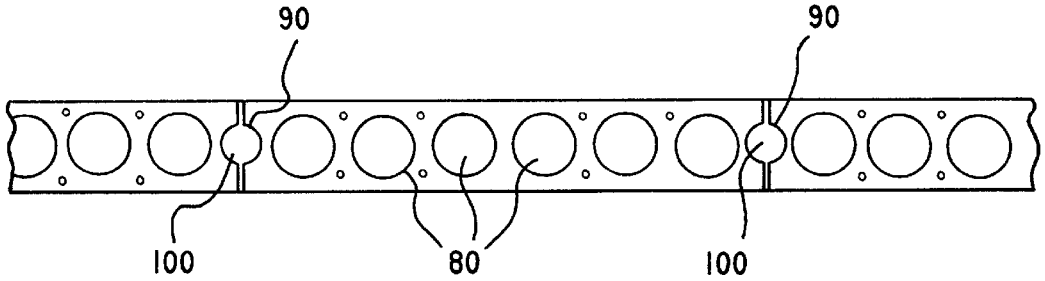
FIG. 4 is a cross sectional view that illustrates the junction of the walls, in accordance with an alternate technique of the present invention.
Figure 5:
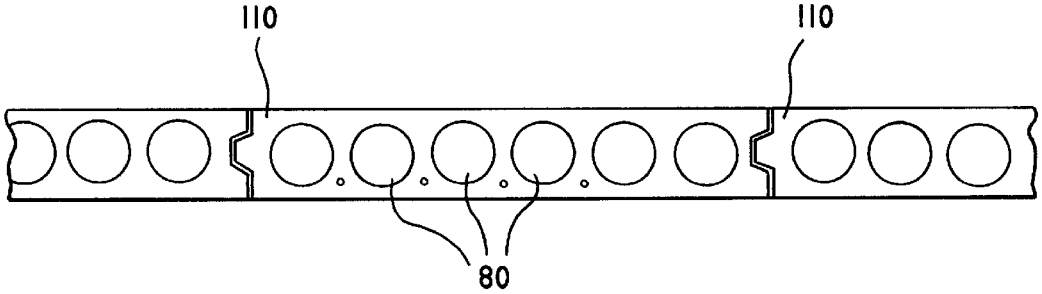
FIG. 5 is a cross sectional view of the junction of the female-male type walls, in accordance with an alternate technique of the present invention.
Figure 6:
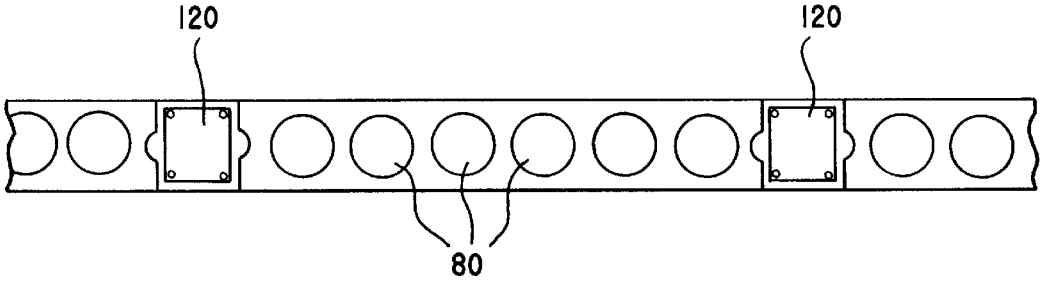
FIG. 6 is a cross sectional view of the junctions of walls by means of castles or head frames poured in situ, in accordance with another alternate technique of the present invention.

FIGS. 4–6 show various alternatives for joining adjacent wall slabs to each other to form the exterior walls of the building.

FIG. 4 shows the cross sectional view of a first embodiment of the junction of the walls. The wall pieces or slabs have longitudinal bores or cavities 80 formed at spaced intervals in the main body thereof. At each end, female-female edges 90 are provided that form a cylindrical cavity 100 when the ends of adjacent wall pieces are abutted. The cavities 100 are filled with cement grout after the slabs are erected and cemented into the foundation members in order to seal the vertical junctions.

FIG. 5 shows a second embodiment of the junction of the walls. These wall pieces also have bores or cavities 80, and have end edges that form a male-female junction 110 which offers stiffness to the vertical junction of the walls. These junctions are grouted as the slabs are assembled.

FIG. 6 shows a third embodiment of the junction of walls. These wall pieces also have bores or cavities 80 but, unlike the previous two illustrations, castles or head frames 120 poured in situ are separately provided at each junction, which seal the vertical junctions. The castles between walls are cast in place, anchoring the vertical rods in the foundation and in the top beam. In high seismic zones, it is considered advisable to use the cast-in place castles between wall pieces, while in seismically safe areas, the walls can be erected without separation as in the first embodiment and the adjacent wall pieces can be joined by fresh poured in place concrete or mortar. Corners of the building are provided by joining the wall pieces to poured in place or prefabricated channel sections, L-shaped sections or T-shaped sections as needed for that particular portion of the building design.

Figure 7:
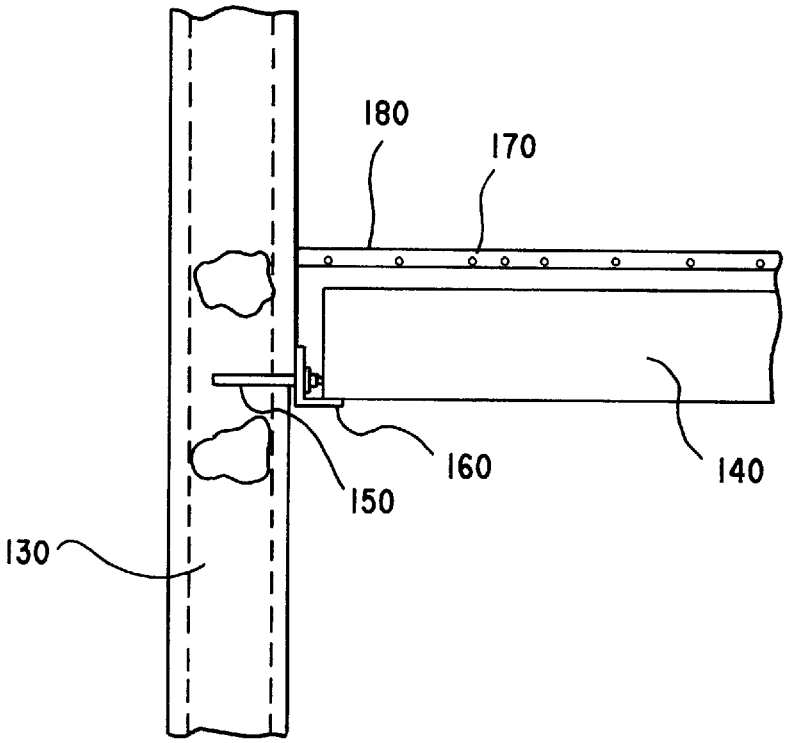
FIG. 7 is a cross sectional view of a floor structure supported over an angle, in accordance with the present invention.

FIG. 7 shows a first embodiment of the junction between the wall 130 and a floor structure slab 140. In this embodiment, a bolt 150 and a support angle iron 160 are connected to the wall piece. The slab 140 is laid over the support angle iron 160. Afterwards, mesh 180 is laid out and solid concrete 170 is poured thereby producing a solid floor reinforced with the mesh 180. Shear walls can also be built either by extension or by being pre-poured in different ways. For example: a canal section, a double T or single T section(s), etc., which may or may not have facade or front panels joined to them can be made on the floor when the solid floor is poured in situ, or can be added by framing with the solid floor later.

Figure 8:
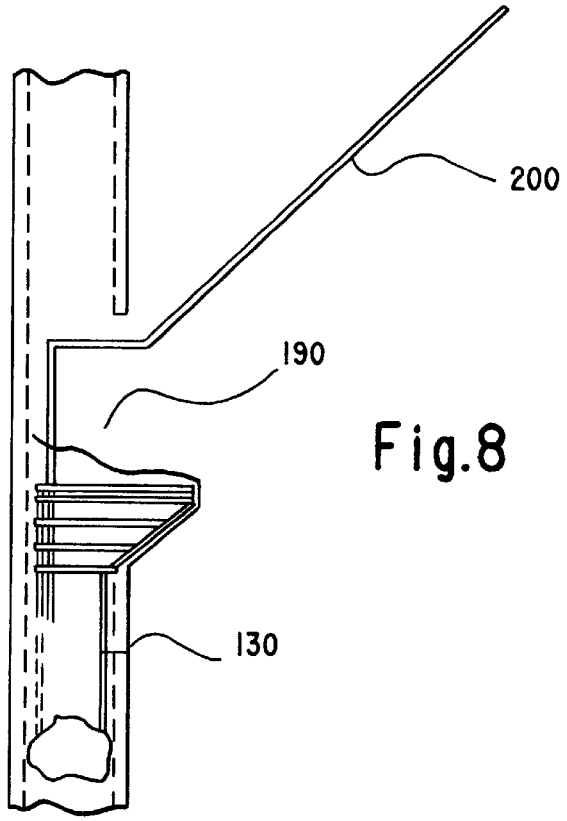
FIG. 8 is a cross sectional view of the bracket, in accordance with the present invention.
Figure 9:
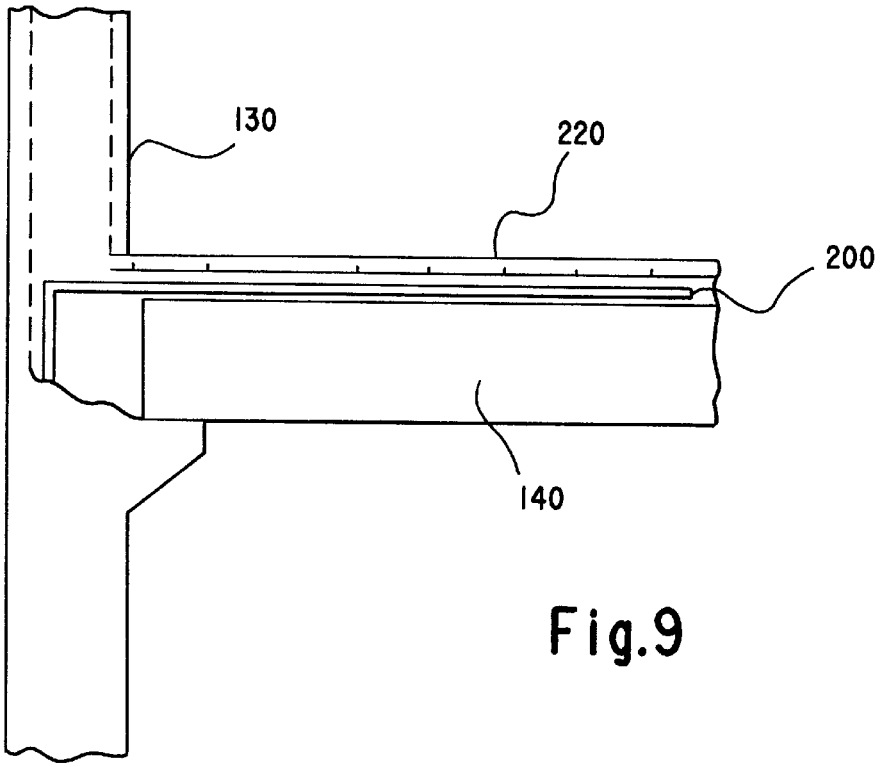
FIG. 9 is a cross sectional view of a floor structure supported by a concrete bracket, in accordance with the present invention.

FIG. 8 shows a second embodiment for the junction between the wall 130 and a floor structure slab 140 in which a box-like slot 190 is formed where end sections of the floor structure slab 140 are to be inserted. A balcony shoulder can be provided at the slot 190. These slots are formed when the horizontal part of the wall piece is cut, leaving only the vertical part, so that the end of the floor structure slab 140 can be introduced into the box-like slot 190 of the wall or simply rested on the balcony shoulder. Some steel rods 200 of the reinforcement are also left so that, as shown in FIG. 9, the rods 200 can be bent downwardly and encased together with the reinforcing mesh 180 in the concrete of the solid floor 220 over the floor structure slabs 140 that will also fill the rest of the box not occupied by the end section of the floor structure slabs 140.

FIG. 10 shows the connection between the wall 130 and the floor structure slab 140 which can have: concrete brackets poured before or after the wall is mounted, or they can be made of a different resistant material; the slab's brackets are introduced in the wall forming the junction between these masses by means of a concrete solid pouring 260 of the floor. The brackets can be either made of concrete, aluminum or special plastics.

FIG. 11 shows the cross sectional view of an alternative having tenons 270 formed or cut on the floor structure slab 140 engaged with cut openings in the wall pieces 130 at the location of the bores or cavities 80 to construct a joint between the floor structure slab 140 and the wall 130.

To form the building's frame, some parapet-beam slabs can be integrated with post-tensing cables, that run through the cavities of these horizontally extending slabs, crossing through the walls, thus anchoring the slabs to the exterior face of the walls, and allowing the erected walls to resist high momentum on the junctions as well as through the entire length of the parapet-beam of every Page 10, lines 1 and 2, please cancel in their entirety and insert the following: floor. The cables are stressed. The cavities that the cables are stretched through are then injected with grout. The grout adheres the cables to the parapet-beam and protects the cables from corrosion. Post-tensing cables are used when the structural design needs to form reticular structures in the orthogonal direction of the precast walls. The strands for the cables used are as normally calculatable. Frequently, use has been made of one or two 0.5" stress relieved 270K. high carbon steel wire cables or bars. These are the same as are used for the reinforcement for the prestressed concrete slabs. The anchor used for the cables are of the wedgesbarrel type at both ends embedded in the exterior sides of the opposite walls.

It should be noted that a 30 cm thick hollow core floor slab can span a distance of 15 m between supports. If the building is wider than 15 m, precast columns and beams can be provided in the center of the building. In such a case, the precast exterior walls in accordance with the present invention can be used as bearing and shearing walls for seismic resistance. Generally, the interior walls of the building are non-load bearing. Standard materials can used for the same. Conventional plumbing, electrical and mechanical operations are used to finish the interior of the building.

In order to make windows, after the building is erected, windows are cut in the walls using a disc cutter machine at the location of the bores or cavities 80. Great care is taken not to cut any reinforcing strands or cables in the wall pieces. Generally, the male webs from between the adjacent cut bores are left in place. Reinforcing bars then are placed around the window opening and the window is finished off.

As an example of what is possible with the present invention, a building of five stories having apartments of 60 $m^2$ can be produced, transported to a site, and erected in approximately 5 days with the number of further days required for plumbing, electrical and mechanical installations and finishing depending upon their complexity. For a social interest housing, a building can be ready for occupancy in 30 days compared with over 300 needed for a conventional building system.

Although we have described and illustrated here one preferred way of implementing this invention, it is obvious that those experts in the field will be able to come up with some changes, nevertheless maintaining its essence and scope. It is the intention that the above description and drawings attached be considered only as an illustration and by no means a limitation to the invention, given that its reach is only defined in terms of the claims that follow:

What I claim is:

1. Procedure for the fast construction of a multi-storied building with precast integral structure elements, characterized by the following steps: building a foundation, either of the box or cradle type, poured either in-situ or precast or mixed; preparing wall structure elements, including sizing each wall structure element to extend at least two stories to an entire height of the building; vertically fixing the wall structure elements to said foundation; connecting the wall structure elements to each other longitudinally to form bearing walls; providing the wall structure elements with fixing and supporting elements; placing and resting integral precast slabs over the supporting elements, thus forming parapet beams; fixing said slabs to the bearing walls by post-tensioning cables that run through cavities in the slabs and cross through the walls thus anchoring the slabs to an exterior face of the bearing walls; and laying further integral precast slabs horizontally over the supporting elements, serving as floor structures and ceilings.

2. Procedure for the fast construction with precast integral structure elements, in accordance with claim 1, further comprising using extruded hollow-cored slabs of prestressed concrete as said wall structure elements, said precast slabs, and said further integral precast slabs.

3. Procedure for the fast construction with precast integral structure elements, in accordance with either of claims 1 or 2, further comprising making the fixing and supporting elements as metallic angles and bolting the angles to the wall structure elements.

4. Procedure for the fast construction with precast integral structure elements, in accordance with either of claims 1 or 2, further comprising making the fixing and supporting elements of bell and spigot connections, by forming boxes in the wall structure elements and cutting the spigots from the precast slabs, pouring concrete to fill the rest of the box not occupied by the spigot at the same time as pouring concrete over said further integral precast slabs and encasing steel rods therein to form a compression solid floor structure.

5. Procedure for the fast construction with precast integral structure elements, in accordance with either of claims 1 or 2, further comprising making the fixing and supporting elements of brackets and anchoring the brackets into boxes opened into the walls.

6. Procedure for the fast construction with precast integral structure elements, in accordance with claim 5, wherein the brackets can be made of material selected from the group consisting of concrete and aluminum.

* * * * *